US005081980A

United States Patent [19]

Newbold

[11] Patent Number: 5,081,980

[45] Date of Patent: Jan. 21, 1992

[54] PLUNGER ARROW REST

[75] Inventor: George T. Newbold, Walla Walla, Wash.

[73] Assignee: Martin Archery, Inc., Walla Walla, Wash.

[21] Appl. No.: 595,391

[22] Filed: Oct. 10, 1990

[51] Int. Cl.[5] ..... F41B 5/22
[52] U.S. Cl. ..... 124/44.5; 124/24.1
[58] Field of Search ..... 124/44.5, 41.1, 24.1, 124/88

[56] References Cited

U.S. PATENT DOCUMENTS

| | | | |
|---|---|---|---|
| 2,975,780 | 3/1961 | Fisher | 124/24.1 |
| 2,980,007 | 4/1961 | Rothgery | 124/24.1 |
| 3,232,286 | 2/1966 | Guyton | 124/24.1 |
| 3,292,607 | 12/1966 | Hoyt, Jr. | 124/44.5 |
| 3,757,764 | 9/1973 | Ikeya | 124/44.5 |
| 3,769,956 | 11/1973 | Simo | 124/44.5 |
| 3,828,757 | 8/1974 | Finlay | 124/44.5 |
| 3,871,352 | 3/1975 | Stanislawski et al. | 124/44.5 |
| 3,918,428 | 11/1975 | Wilson et al. | 124/44.5 |
| 3,919,997 | 11/1975 | Day | 124/44.5 |
| 4,119,078 | 6/1978 | Wilson et al. | 124/44.5 |
| 4,133,334 | 1/1979 | Tone | 124/44.5 |
| 4,170,980 | 10/1979 | Killian | 124/44.5 |
| 4,278,066 | 7/1981 | Zinz, Sr. | 124/44.5 |
| 4,299,195 | 11/1981 | Norris | 124/24.1 |
| 4,398,528 | 8/1983 | Troncoso, Jr. | 124/24.1 |
| 4,548,189 | 10/1985 | Pietraszek et al. | 124/44.5 |
| 4,686,956 | 8/1987 | Troncoso, Jr. | 124/44.5 |
| 4,732,135 | 3/1988 | Simo | 124/44.5 |
| 4,748,964 | 6/1988 | Troncoso, Jr. | 124/44.5 |
| 4,809,670 | 3/1989 | Simo | 124/44.5 |
| 4,867,129 | 9/1989 | Scherz | 124/41.1 |
| 4,924,841 | 5/1990 | Smith | 124/44.5 |

FOREIGN PATENT DOCUMENTS 3424744 1/1986 Fed. Rep. of Germany ..... 124/44.5

OTHER PUBLICATIONS

Bow Hunters Warehouse Advertisement, p. 37.

*Primary Examiner*—Peter M. Cuomo
*Attorney, Agent, or Firm*—Wells, St. John & Roberts

[57] ABSTRACT

An arrow rest apparatus for attachment to an archery bow handle comprises a cushion plunger assembly and an arrow support. The cushion plunger assembly has an elongated inner plunger and an elongated outer sleeve, the inner plunger being received within the outer sleeve and projecting therefrom. The inner plunger is outwardly biased to an extended position relative to the outer sleeve and is depressible to a depressed position against the bias to absorb side pressure exerted by an arrow in the direction of the bow upon shooting. The cushion plunger assembly is laterally mountable through an archery bow handle to engage a side of an arrow with the inner plunger. Upper and lower mounting holes extend through the outer sleeve and are generally vertically opposed and aligned. A slot is formed longitudinally through the elongated inner plunger. The slot is aligned with the outer sleeve mounting holes to provide a passage through the plunger between the mounting holes as the inner plunger is moved between the extended and depressed positions. The arrow support has a support arm that arm extends outwardly from the cushion plunger assembly at an elevation which is generally below the plunger. The arrow support is mounted to the cushion plunger assembly through the mounting holes and the slot to permit pivoting of the support arm within a generally horizontal plane. The support arm is biased to a resting pivotal position by an elastic band.

19 Claims, 3 Drawing Sheets

PLUNGER ARROW REST

TECHNICAL FIELD

This invention relates to arrow rests for archery bows.

BACKGROUND OF THE INVENTION

Arrow rests are typically attached to an archery bow for supporting an arrow before and during release. Many arrow rests provide a degree of support to at least one side of an arrow while the bowstring is drawn and the arrow is released. This accommodates horizontal oscillations generated in the arrow shaft during release and acceleration of the arrow.

Upon release of a bowstring, tremendous driving forces are applied to the rear end of an arrow. In theory, if the forces are perfectly aligned with the axis of the arrow, with no induced horizontal or vertical forces, the arrow shaft will remain straight during its initial flight. As a practical matter, however, it is impossible for even the most skilled archers to apply all of the bow force along the axis of the arrow. Invariably, both horizontal and vertical off-axis forces are applied which cause the arrow to bend or flex.

The degree of these off-axis forces depends in part upon how the bowstring is released. When archers hold and release the bowstring with their fingers ("finger release") the bowstring rolls or slides off the fingers. This imparts a significant lateral or horizontal force to the rear of the arrow and causes the arrow to bend or bow in a horizontal plane. The arrow subsequently goes through a series of alternating left and right bowing or flexing motions. This alternating horizontal bowing is commonly referred to as "archers' paradox" or "fishtailing."

At one time, fishtailing was thought to be desirable to allow the fletched rear end of the arrow to bend around and to clear the sidewall of the bow. However, while the arrow fletching eventually stabilizes arrow flight and eliminates the bending oscillations of the shaft, fishtailing has a material and detrimental impact on arrow flight, arrow speed, shot repeatability, and shot accuracy. Accordingly, modern arrow rests are designed to reduce fishtailing while generally minimizing or avoiding significant interference between the arrow rest and the arrow fletching.

A cushion plunger, also known as a "Berger" button, is a simple and popular device for providing lateral arrow support to damp horizontal arrow oscillations. A cushion plunger generally comprises an elongated outer sleeve and an elongated inner plunger. The outer sleeve is cylindrical with external threads for lateral mounting through a threaded opening in an archery bow handle. The inner plunger is received within the outer sleeve and projects laterally therefrom to engage a side of an arrow. The inner plunger is outwardly biased to an extended position relative to the outer sleeve. It is depressible within the outer sleeve against the bias to absorb side pressure exerted by an arrow in the direction of the bow upon shooting, thus damping horizontal arrow oscillations. The strength of the outward biasing is typically adjustable to accommodate different archers, equipment, and shooting styles.

The cushion plunger is largely effective for supporting an arrow away from the sidewall of an archery bow handle and for damping horizontal oscillations. However, additional components or devices are needed for providing vertical support to an arrow. Therefore, arrow rests typically incorporate arrow supports for supporting an arrow from beneath. A cushion plunger is sometimes used in conjunction with a separate arrow support, although many arrow rests incorporate components to elevationally support an arrow as well as to dampen horizontal oscillations.

Martin Archery's 1990 archery equipment catalog, at pages 16–20, illustrates a number of popular arrow rests which include arrow support members. These and other rests are effective and popular. Where both a cushion plunger and a separate arrow support member are used, however, they must be separately attached to the bow handle. While convenient standards have developed for mounting a cushion plunger to a bow handle, some vertical support members must be glued or otherwise inconveniently attached to the bow. The mounting of some vertical supports is somewhat permanent and forecloses the possibility of later adjustment without removing and replacing the rest.

Rather than being mounted directly to the bow handle, some arrow rests include brackets for mounting to a cushion plunger, taking advantage of the convenient mounting standards for cushion plungers. However, these brackets typically result in more sophisticated and expensive arrow rests which are not desired by all archers.

Accordingly, archers have felt and continue to feel a need for a simple arrow rest which retains the mounting and operational advantages of the cushion plunger, adds the capability of an arrow support member, and does so without adding significant complexity or cost.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

A preferred embodiment of an arrow rest apparatus according to this invention for attachment to an archery bow handle to support an arrow before and during release from the bow is generally designated by the numeral 10 in FIGS. 1–6. Arrow rest apparatus 10 generally comprises a cushion plunger assembly 12 and an arrow support 14.

Figure 1:
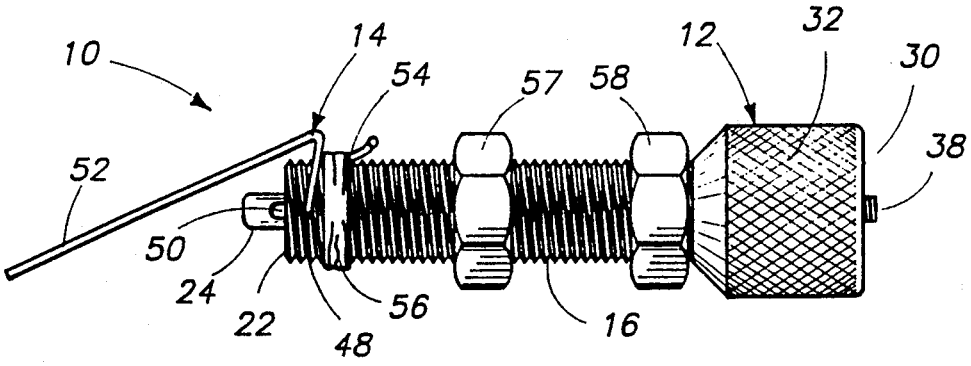
FIG. 1 is a bottom view of an arrow rest apparatus according to this invention.
Figure 2:
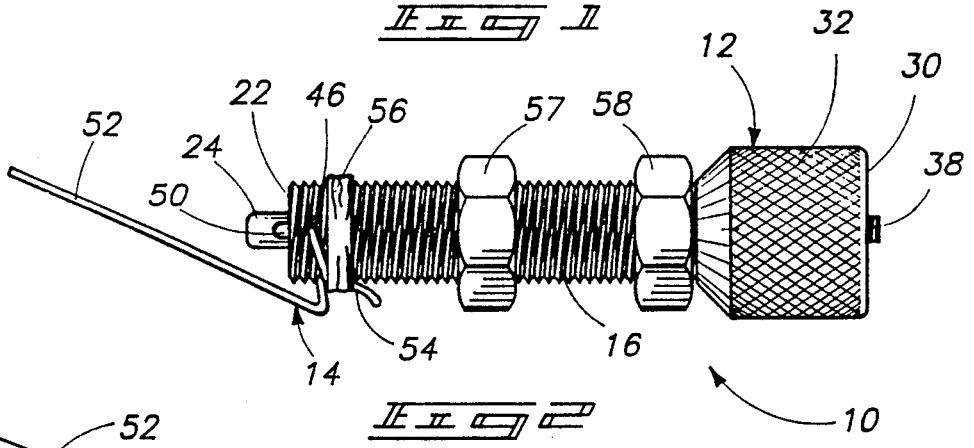
FIG. 2 is an upper view of the arrow rest apparatus of FIG. 1.
Figure 3:
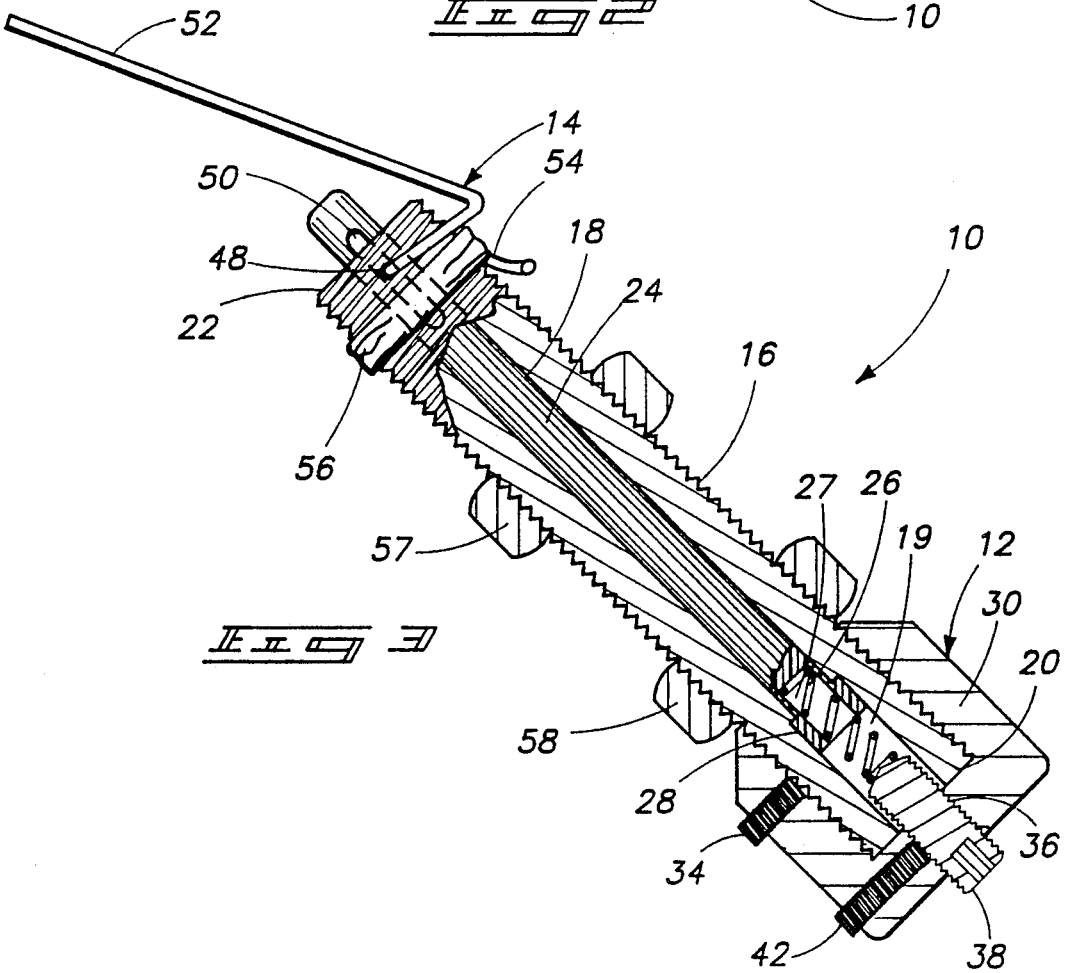
FIG. 3 is an enlarged bottom view of the arrow rest apparatus of FIG. 1, with a section broken away to show internal construction.

Cushion plunger assembly 12 comprises a cylindrical, externally threaded, elongated outer sleeve 16 having a base end 20 and a projecting end 22 (FIG. 3). A longitudinal bore 18 extends coaxially through outer sleeve 16 from its base end 20 to its projecting end 22. Outer sleeve 16 has an enlarged diameter concentric counterbore 19 at base end 20.

A cylindrical elongated inner plunger 24 is received within longitudinal bore 18, and projects therefrom. Plunger 24 has an outer diameter which is complementary to the diameter of longitudinal bore 18 to be slidable therewithin. Plunger 24 has an enlarged head 28 that has a diameter approximately complementary to the enlarged diameter of counterbore 19. A plunger bore 27 extends longitudinally and concentrically into plunger 24 at enlarged head 28.

A coiled spring 26 is partially received within plunger bore 27 and within counterbore 19. Spring 26 outwardly biases plunger 24 to an extended position relative to outer sleeve 16. Plunger 24 is depressible within bore 18 against the bias of spring 26 to a depressed position. Outward extension of plunger 24 from outer sleeve 16 is limited by interference between enlarged head 28 and a shoulder defined by narrower bore 18.

Cushion plunger assembly 12 includes an enlarged cylindrical end cap 30 which is threadably and coaxially received over base end 20 of elongated sleeve 16. End cap 30 has a knurled outer surface 32 for convenient grasping. A first set screw 34 extends threadably through a side of end cap 30 and is tightened against outer sleeve 16 to adjustably secure end cap 30 to outer sleeve 16. End cap 30 has coaxial threaded hole 36 which has a diameter slightly smaller than that of enlarged counterbore 19. An adjusting screw 38 is threadably received through hole 36 to compress spring 26 within longitudinal bore 18 and against plunger 24. The tension of spring 26 against plunger 24 is adjusted by inward and outward threading of screw 38. A second set screw 42 extends threadably through a side of end cap 30 to secure adjusting screw 38 once the tension of spring 26 has been selectively set.

Upper and lower mounting holes 46 and 48 are provided to extend through outer sleeve 16 adjacent its projecting end 22. Mounting holes 46 and 48 are generally vertically opposed and aligned. A slot or longitudinally elongated aperture 50 is formed through inner plunger 24. It is aligned with mounting holes 46 and 48 to provide a passage through plunger 24 between mounting holes 46 and 48 as inner plunger 24 is moved from an extended position to a depressed position.

Arrow support 14 is mounted to cushion plunger assembly 12 through mounting holes 46 and 48 and lateral aperture 50. Arrow support 14 preferably comprises a one piece metal wire extending through mounting holes 46 and 48 and slot 50. Arrow support wire 14 extends outwardly from the lower mounting hole 48 at an elevation that is generally below the plunger to form a support arm 52. Arrow support wire 14 is sized and mounted to be pivotal within mounting holes 46 and 48 to allow pivoting in a generally horizontal plane.

Arrow support wire 14 also includes an integral projecting portion 54 which extends at least partially along and adjacent outer sleeve 16 of cushion plunger assembly 12 from upper mounting hole 46. A biasing means or elastic band 56 is received around cushion plunger assembly 12 and over wire projection 54. Elastic band 56 thus engages wire projection 54 to elastically bias projection 54 against outer sleeve 16 of cushion plunger assembly 12, thus biasing arrow support wire 14 to a resting pivotal position.

Support arm 52 of wire 14 is angled such that it will contact an arrow at approximately the same general location along the arrow as does plunger 24. Specifically, support arm 52 extends rearwardly from mounting hole 48 and then angles outwardly and slightly forward from cushion plunger assembly 12.

Figure 4:
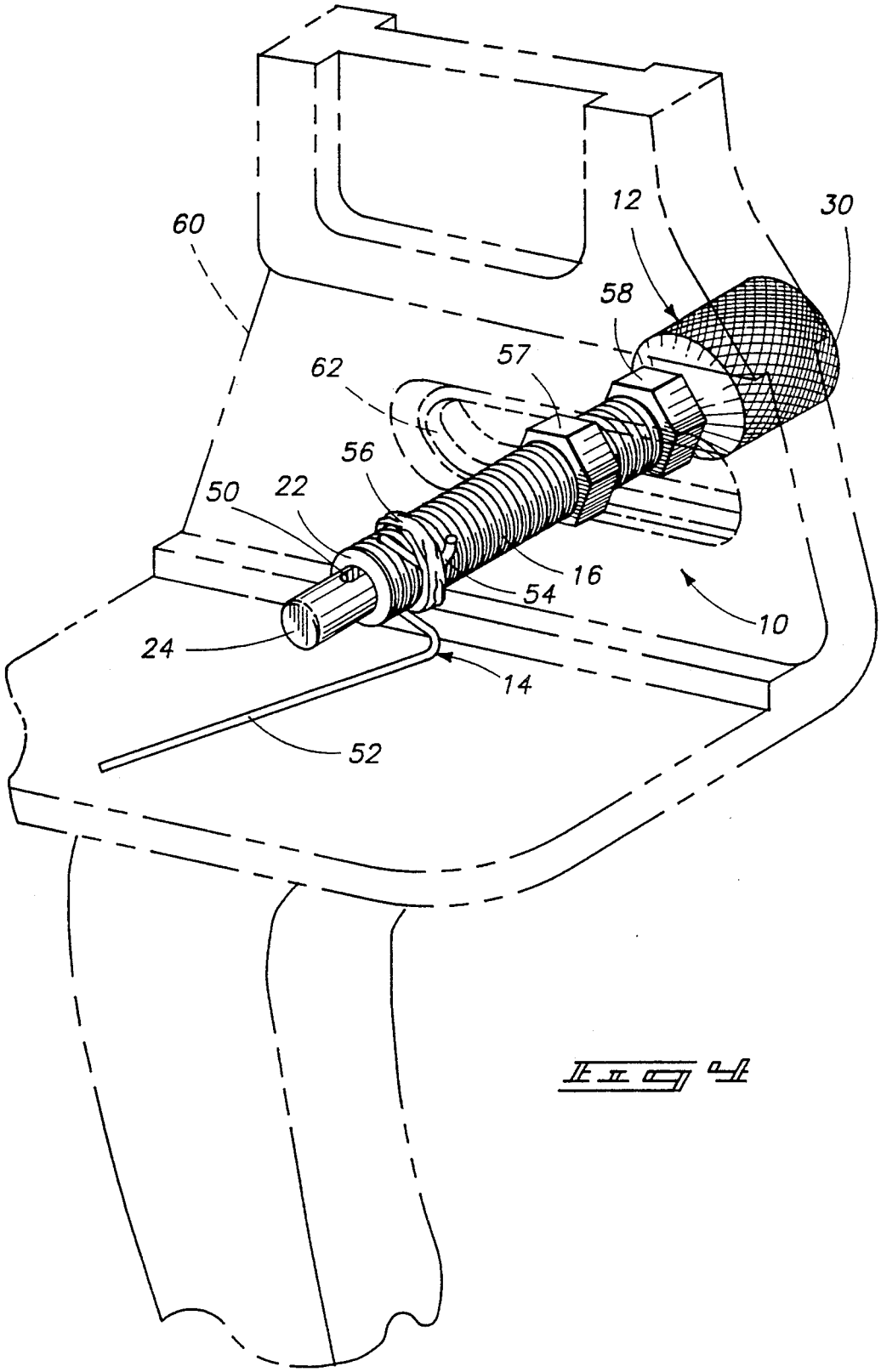
FIG. 4 is an enlarged perspective view of the arrow rest apparatus of FIG. 1 mounted to an archery bow handle that is shown in dashed lines.

Hex mounting nuts 57 and 58 are threadably received over outer sleeve 16 for mounting cushion plunger assembly 10 to a bow handle 60 (FIG. 4). Bow handle 60 includes a mounting slot 62 for receiving cushion plunger 10. Such a bow is shown by way of example in our U.S. Pat. No. 4,889,102.

Figure 5:
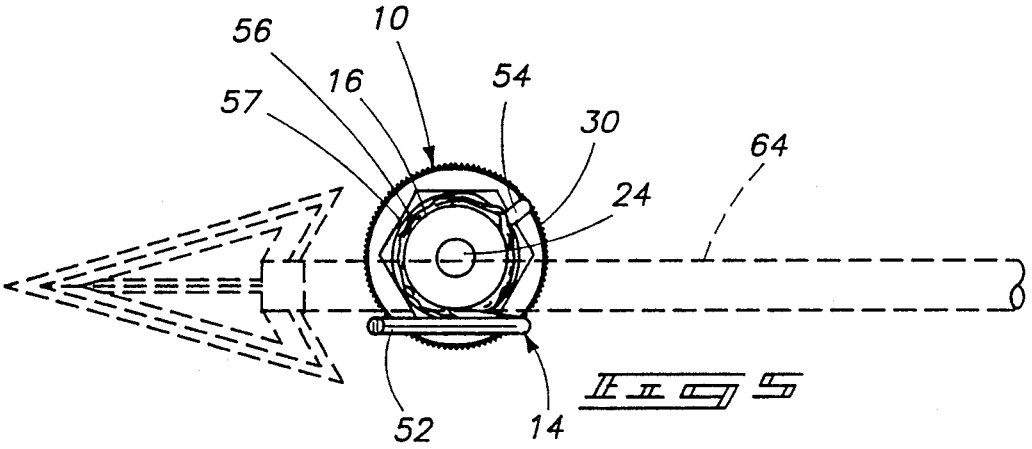
FIG. 5 is an enlarged end view of the arrow rest apparatus of FIG. 1 showing an arrow (in dashed lines) in the fully drawn position.

FIG. 5 shows arrow support 14 in its resting position supporting a fully drawn arrow 64. In its resting position, support arm 52 is pivoted rearward by the bias of elastic band 56. Projection 54 lies against elongated sleeve 16, thus forming limiting means for limiting rearward pivoting of arrow support wire 14 from the resting pivotal position.

Figure 6:
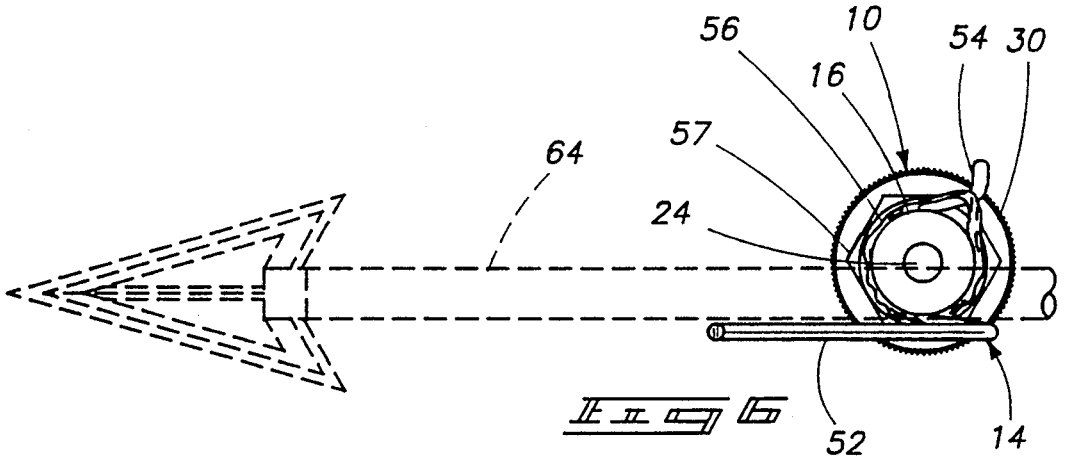
FIG. 6 is an enlarged end view of the arrow rest apparatus of FIG. 1 showing an arrow (in dashed lines) moving forward during release.

FIG. 6 shows arrow support wire 14 having been pivoted forward from its resting position by arrow 64 upon its release. Projection 54 is pivoted away from elongated sleeve 16 against the bias of elastic band 56, thus minimizing forward resistance of arm 52 against forward moving arrow 62.

An arrow rest apparatus for attachment to an archery bow handle is thus provided to support an arrow before and during release from the bow. Support arm 52 provides a pivoting arrow support member for elevational support of an arrow. Inner plunger 24 of cushion plunger assembly 12 engages the side of an arrow and is depressible to absorb side pressure exerted by an arrow in the direction of the bow upon shooting. Accordingly, the preferred embodiment arrow rest apparatus 10 provides, in a single integral unit, both lateral and vertical arrow support, while combining the advantages of a cushion plunger and an arrow support member. Further, existing standards of mounting a cushion plunger to a bow handle may be used to conveniently and inexpensively mount the entire arrow rest apparatus.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An arrow rest apparatus for attachment to an archery bow to support an arrow before and during release from the bow, the arrow rest apparatus comprising:

a cushion plunger assembly having an elongated and projecting plunger, the cushion plunger assembly being mountable to an archery bow to engage a side of an arrow with the plunger, the plunger being outwardly biased to an extended positon and being depressible to a depressed position within the assembly against the bias to absorb side pressure exerted by an arrow in the direction of the bow upon shooting;

at least one longitudinally elongated aperture extending through the plunger;

a wire extending through the aperture, the wire being sized and mounted to be pivotal within the aperture and mounted to remain laterally stationary relative to the cushion plunger assembly as the plunger is moved between the extended and depressed positions, the wire extending outwardly from the cushion plunger assembly at an elevation that is generally below the plunger to support an arrow; and biasing means engaging the wire and the cushion plunger assembly for elastically biasing the wire to a resting pivotal position.

2. An arrow rest apparatus according to claim 1 wherein the longitudinally elongated aperture comprises a longitudinally elongated slot.

3. An arrow rest apparatus according to claim 1 wherein the biasing means comprises an elastic band received around the cushion plunger assembly and engaging the wire.

4. An arrow rest apparatus according to claim 1 further comprising limiting means for limiting rearward pivoting of the wire from the resting pivotal position.

5. An arrow rest apparatus according to claim 1 wherein the wire has a projecting portion extending at least partially along the cushion plunger assembly that is biased against the cushion plunger assembly by the biasing means.

6. An arrow rest apparatus according to claim 1 wherein the wire extends outward and forward from the cushion plunger assembly.

7. An arrow rest apparatus for attachment to an archery bow handle to support an arrow before and during release from the bow, the arrow rest apparatus comprising:

a cushion plunger assembly having an elongated inner plunger and an elongated outer sleeve, the inner plunger being received within the outer sleeve and projecting therefrom, the inner plunger being outwardly biased to an extended position relative to the outer sleeve, the inner plunger being depressible to a depressed position against the bias to absorb side pressure exerted by an arrow in the direction of the bow upon shooting, the cushion plunger assembly being laterally mountable through an archery bow handle to engage a side of an arrow with the inner plunger;

upper and lower mounting holes extending through the outer sleeve, the mounting holes being generally vertically opposed and aligned;

a slot formed longitudinally through the elongated inner plunger, the slot being aligned with the outer sleeve mounting holes to provide a passage through the plunger between the mounting holes as the inner plunger is moved between the extended and depressed positions;

an arrow support having a support arm, the support arm extending outwardly from the cushion plunger assembly at an elevation which is generally below the plunger, the arrow support being mounted to the cushion plunger assembly through the mounting holes and the slot to permit pivoting of the support arm within a generally horizontal plane;

the arrow support including a projection which extends at least partially along and adjacent the outer sleeve; and an elastic band received around the outer sleeve and engaging the projection to bias the projection against the outer sleeve and thereby bias the arrow support arm to a resting pivotal position.

8. An arrow rest apparatus according to claim 7 further comprising limiting means for limiting rearward pivoting of the support arm from the resting pivotal position.

9. An arrow rest apparatus according to claim 7 wherein the support arm extends outward and forward from the cushion plunger assembly.

10. An arrow rest apparatus according to claim 7 wherein the support arm extends from the lower mounting hole and the projection extends from the upper mounting hole.

11. An arrow rest apparatus according to claim 7 wherein the projection is an integral part of the support arm.

12. An arrow rest apparatus for attachment to an archery bow to support an arrow before and during release from the bow, the arrow rest apparatus comprising:

a cushion plunger assembly having an elongated inner plunger and an elongated outer sleeve, the inner plunger being received within the outer sleeve and projecting therefrom, the inner plunger being outwardly biased to an extended position relative to the outer sleeve, the inner plunger being depressible to a depressed position against the bias to absorb side pressure exerted by an arrow in the direction of the bow upon shooting, the cushion plunger assembly being laterally mountable through an archery bow handle to engage a side of an arrow with the inner plunger;

upper and lower mounting holes extending through the outer sleeve;

a slot formed longitudinally through the elongated inner plunger, the slot being aligned with the outer sleeve mounting holes to provide a passage through the plunger between the mounting holes as the inner plunger is moved between the extended and depressed positions; and an arrow support having a support arm, the support arm extending outwardly from the cushion plunger assembly at an elevation which is generally below the inner plunger, the arrow support being mounted to the cushion plunger assembly through the mounting holes of the outer sleeve and the slot of the inner plunger.

13. An arrow rest apparatus according to claim 12 wherein the support arm extends outward and forward from the cushion plunger assembly.

14. An arrow rest apparatus according to claim 12 wherein the support arm extends outward from adjacent the lower mounting hole.

15. An arrow rest apparatus according to claim 12 wherein the support arm is mounted for pivotal movement within a generally horizontal plane.

16. An arrow rest apparatus for attachment to an archery bow to support an arrow before and during release from the bow, the arrow rest apparatus comprising:

a cushion plunger assembly having an elongated inner plunger and an elongated outer sleeve, the inner plunger being received within the outer sleeve and projecting therefrom, the inner plunger being outwardly biased to an extended position relative to the outer sleeve, the inner plunger being depressible to a depressed position against the bias to absorb side pressure exerted by an arrow in the direction of the bow upon shooting, the cushion plunger assembly being laterally mountable through an archery bow handle to engage a side of an arrow with the inner plunger;

upper and lower mounting holes extending through the outer sleeve;

a slot formed longitudinally through the elongated inner plunger, the slot being aligned with the outer sleeve mounting holes to provide a passage through the plunger between the mounting holes as the inner plunger is moved between the extended and depressed positions; and an arrow support having a support arm, the support arm extending outwardly from the cushion plunger assembly at an elevation which is generally below the inner plunger, the arrow support being mounted to the cushion plunger assembly through the mounting holes of the sleeve and the slot and being supported for pivotal movement within a generally horizontal plane;

wherein the arrow support includes a projection which extends at least partially along and adjacent the outer sleeve, the arrow rest apparatus further comprising an elastic band received around the outer sleeve and engaging the projection to bias the projection against the outer sleeve and to thereby bias the arrow support arm to a resting pivotal position.

17. An arrow rest apparatus according to claim 12 wherein the mounting holes are generally vertically opposed and aligned.

18. An arrow rest apparatus for attachment to an archery bow to support an arrow before and during release from the bow, the arrow rest apparatus comprising:

a cushion plunger assembly having an elongated, outwardly biased, and projecting plunger, the cushion plunger assembly being mountable to an archery bow to engage a side of an arrow with the plunger, the plunger being outwardly biased to an extended position and being depressible to a depressed position within the assembly against the bias to absorb side pressure exerted by an arrow in the direction of the bow upon shooting;

at least one longitudinally elongated aperture extending through the plunger;

a wire extending through the aperture, the wire being sized and mounted to be pivotal within the aperture and mounted to remain laterally stationary relative to the cushion plunger assembly as the plunger is moved between the extended and depressed positions, the wire extending outwardly from the cushion plunger assembly at an elevation that is generally below the plunger to support an arrow; and biasing means engaging the wire and the cushion plunger assembly for elastically biasing the wire to a resting pivotal position, the biasing means comprising an elastic band received around the cushion plunger assembly and engaging the wire.

19. An arrow rest apparatus for attachment to an archery bow to support an arrow before and during release from the bow, the arrow rest apparatus comprising:

a cushion plunger assembly having an elongated, outwardly biased, and projecting plunger, the cushion plunger assembly being mountable to an archery bow to engage a side of an arrow with the plunger, the plunger being outwardly biased to an extended position and being depressible to a depressed position within the assembly against the bias to absorb side pressure exerted by an arrow in the direction of the bow upon shooting;

at least one longitudinally elongated aperture extending through the plunger;

a wire extending through the aperture, the wire being sized and mounted to be pivotal within the aperture and mounted to remain laterally stationary relative to the cushion plunger assembly as the plunger is moved between the extended and depressed positions, the wire extending outwardly from the cushion plunger assembly at an elevation that is generally below the plunger to support an arrow, the wire having a projecting portion extending from the cushion plunger assembly and at least partially along and external to the cushion plunger assembly; and biasing means engaging the projecting portion of the wire to bias the projecting portion of the wire against the cushion plunger assembly and to thereby bias the wire to a resting pivotal position.

* * * * *